United States Patent [19]

Brooke

[11] 3,991,999

[45] Nov. 16, 1976

[54] REVOLVING STRIPPER FINGER

[75] Inventor: Edric Raymond Brooke, Welwyn Garden City, England

[73] Assignee: Xerox Corporation, Stamford, Conn.

[22] Filed: Sept. 4, 1975

[21] Appl. No.: 610,502

[52] U.S. Cl. ..... 271/174; 271/DIG. 2

[51] Int. Cl.[2] ..... B65H 29/54

[58] Field of Search ..... 271/DIG. 2, 80, 174; 118/245; 34/120; 100/174; 355/3 R

[56] References Cited

UNITED STATES PATENTS

| | | | |
|---|---|---|---|
| 2,067,404 | 1/1937 | Marchev | 271/DIG. 2 |
| 3,421,757 | 1/1969 | Boisseau | 271/80 |
| 3,450,402 | 6/1969 | Weiler | 271/DIG. 2 |

*Primary Examiner*—Robert W. Saifer

[57] ABSTRACT

A sheet stripping apparatus for an electrostatographic copying machine for separating copy sheets from the copying machine photoreceptor following image transfer. The stripping apparatus as aforesaid consists of one or more disc like elements, supported for rotation upon an arm such that the arcuate edge of the disc is in stripping contact with the photoreceptor surface downstream of the transfer station. In one embodiment, control means are provided to bring the stripping disc or discs into and out of contact with the photoreceptor in timed relationship to movement of the copy sheet. In another embodiment, means are provided to turn the disc, either continuously or by increments, so as to present fresh disc surface and avoid flats.

18 Claims, 5 Drawing Figures

REVOLVING STRIPPER FINGER

This invention generally relates to sheet handling technology and more particularly concerns a method and means for stripping sheet material from a sheet carrying surface.

In one well known form of automatic electrostatographic reproduction machine, a moving photoconductive plate or photoreceptor, generally in the form of an endless surface, such as a drum or the like, is uniformly charged and the surface then exposed to a light pattern of the image sought to be reproduced to thereby discharge the charge in the areas where light strikes the plate. The undischarged areas of the layer thus form an electrostatic charge pattern in conformity with the configuration of the original image pattern.

This electrostatic latent image may then be developed into visible form by applying a developer material, either a powder or liquid to the plate using any one of a number of development means generally known and used in the art. Subsequent to the development operation, the now visible image is transferred from the plate to a sheet of final support material, or carrier, such as paper or the like, and suitably affixed to it thereby forming a permanent print.

The transfer step includes bringing the developed photoreceptor surface into contact with the surface of the image support material, effecting the transposition of the developed image from the photoreceptor surface to the support material surface by suitable means while the two are in contact and separating the image bearing carrier sheet from the photoreceptor.

Because of the strong electrostatic attraction between the carrier sheet and the photoreceptor, separation cannot depend upon gravity but requires an additional external force. An example of a proposed means used to provide this external stripping force includes thin wedge-like fingers which are inserted between the carrier paper and the drum. Also proposed are the use of a fluid steam such as air which is directed toward the photoreceptor surface and the lead edge of the carrier in the stripping zone.

According to the present invention there is provided a device for stripping sheet material from a sheet carrying surface moving relative thereto including a support arm having a rotatable tip means attached thereto adjacent one end for contacting said carrying surface, said tip means having an edge of a generally circular configuration contacting said carrying surface.

This invention will be more fully understood by referring to the accompanying drawing in which.

Figure 1:
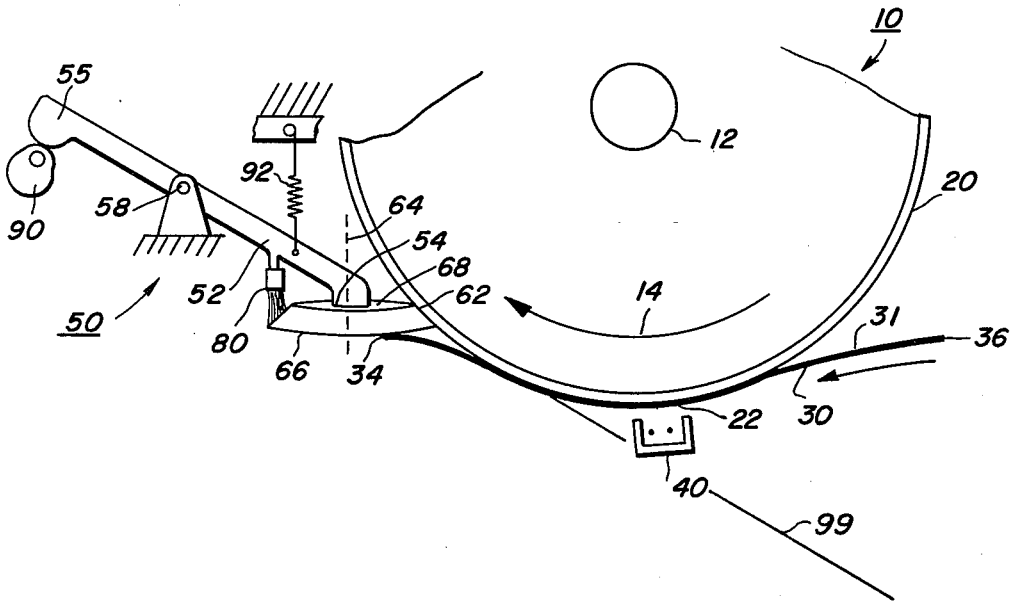
FIG. 1 is a schematic side elevational view of an embodiment of the sheet material stripping device of the invention in an electrostatographic copying machine.
Figure 2:
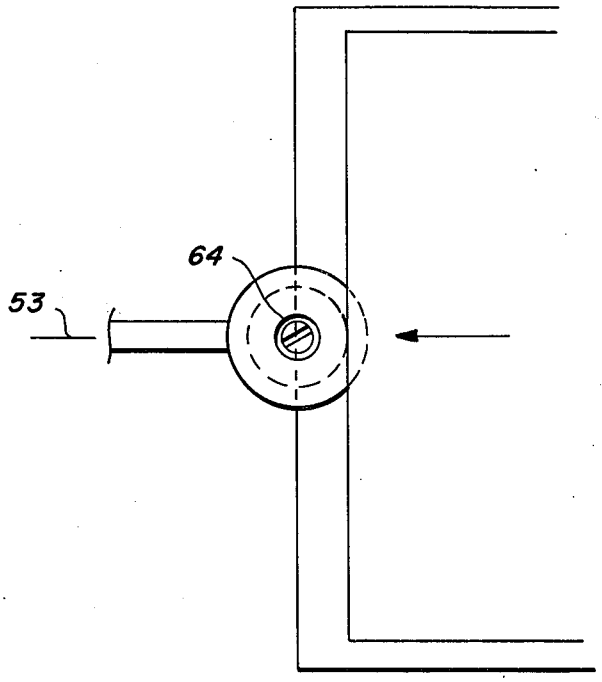
FIG. 2 is a view of the structure of FIG. 1 from below.

Referring to FIG. 1, there may be seen an embodiment of the invention in an electrostatographic copying apparatus having a cylindrical photoreceptor 10 with a photoconductive surface 20 rotating about an axis 12 in a direction indicated by the arrow 14. In the process, a sheet of image supporting material 30, moving in a timed relation to the surface 20, is brought into contact with a developed image on surface 20 in a transfer zone 22. Application of a suitable electrical charge to the sheet material 30 by means such as shown for example by the corotron 40 causes the developed image to release from the surface 20 and transfer to the surface 31 of the sheet material. This transfer step causes the sheet material 30 to be attracted to the surface 20 such that an external separating force must usually be applied to separate one from the other.

According to the present invention, this force is provided by an efficient and reliable stripping means generally indicated at 50 which includes a support arm 52 having a rotatable tip means 60 adjacent to one end and a pivot point 58 remote therefrom. The tip means 60 is attached to end 54 of support arm 52 such that an edge 62 of the tip means 60 contacts the carrying surface 20 to force the leading edge 34 of sheet 30 away from the surface and along a predetermined path to an output area of the machine.

The tip 60 advantageously is of a circular disc configuration and rotatably connected at its center 64 to the support arm end 54. The disc shown in FIG. 1 has first and second generally circular sides 66, 68 respectively. Side 66 has a greater diameter than side 68 and the disc 60 is positioned with the smaller side 68 closest to the end 54 and carrying surface 20. Thus, edge 62 is the area with limits defined by the circumferences of the first and second sides 66, 68.

Figure 4:
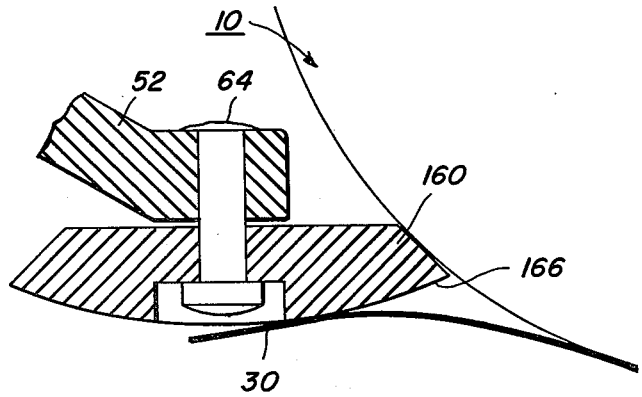
FIG. 4 is a sectional view of the stripping device showing how its outer surface can be advantageously shaped.

As shown in FIG. 4 the disc 160 is similar in configuration and function to disc 60 except that it has a domed or convex second side 166 which presents a more limited area of contact with developed sheet material 30.

Figure 3:
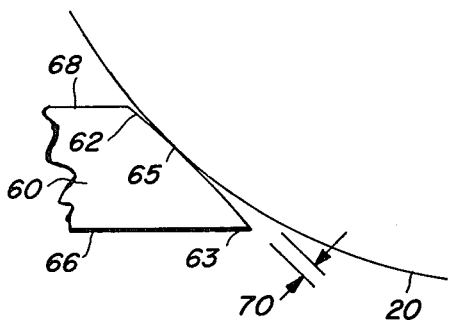
FIG. 3 is a greatly enlarged elevational view showing the relationship between an embodiment of the stripping device edge and a sheet material carrying surface.

In one preferred embodiment of the invention, the configuration of edge 62 may be such that it makes contact with the cylindrical surface 20 only at one point 65. A frusto-conical shape to the edge would provide such point contact as shown in FIG. 3 at 65.

A feature of the invention is that the point contact 65 occurs such that the portion 63 of the edge 62 at the circumference of said first side 66 is spaced from the surface 20 as shown at 70. This spacing of the forward edge lip 63 avoids the possibility of gouging surface 20 and provides a smooth ride of the stripping means 50 on the surface 20. Nevertheless, a concave edge surface 62 generally conforming to the contacted cylindrical carrying surface 20 may be acceptable under many conditions. Where the material being stripped is 0.0035 inches thick it has been found that a spacing 70 of the order of 0.0005 inches produces satisfactory results.

The tip 60 may be disposed in a plane which is parallel to a plane including the axis 12 about which surface 20 revolves. In such case, the lines of force on the tip 60 through the point of contact 65 will extend through the center 64 and be generally symmetrical about the centerline of the support 52. If however the tip 60 lies in a plane which is not parallel to a plane including the axis 12, the line of force on the tip through the point 65 would not pass entirely through the center 64 but would have a tangential component that would cause rotation of the tip 60. Where free rotation is allowed, an advantage is that a new stripping edge is being continuously presented thereby greatly prolonging tip life and reducing maintenance. A further advantage of this rotation of the edge 62 is that a cleaning means such as a brush 80 suitably positioned, as for example by attachment to support arm 52, cleans the edge of any accumulation of extraneous developer particles or other contamination which may be present.

To cycle the tip 60 out of contact with the surface 20, as may be desirable under certan conditions, a control means may be provided. Thus, as shown in FIG. 1, the support arm 52 may have associated therewith a cam follower portion 55 in contact with a rotatable cam means 90. With the cam 90 controlled to rotate in a predetermined relationship to the movement of the sheet material 30 and surface 20, the cam may be set to move the arm 52 and tip 60 about a pivot point 58 into engagement with the surface 20 just before the lead edge 34 of the sheet material 30 reaches the stripping point and move it out of engagement after the trail edge 36 passes that point.

Figure 5:
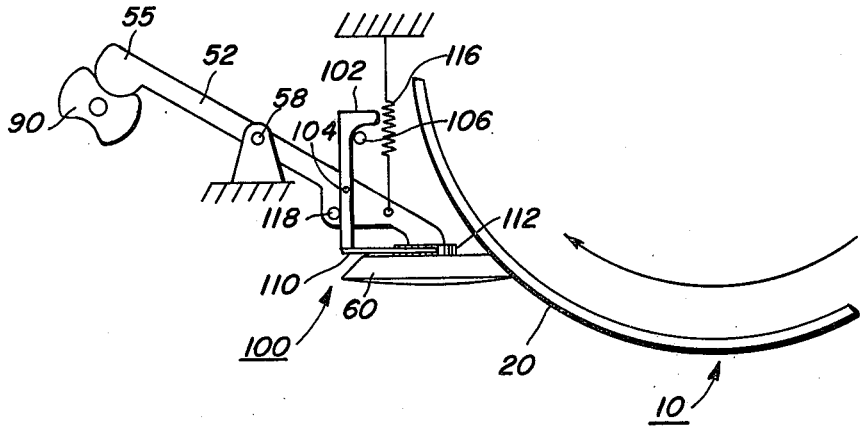
FIG. 5 is a schematic elevational view of one means of rotating the stripping disc.

For each cycle into and out of engagement the control means may include a member which contacts the tip 60 as it swings away from the surface 20 to rotate it a predetermined amount. One such means is schematically shown at 100 in FIG. 5 where it may be seen that as the cam 90 rotates in a clockwise direction from the point shown in FIG. 5 it will pivot arm 52 about fulcrum 58 to move tip 60 away from drum 10 and, by pawl and ratchet action connected therewith, rotate disc 60. As shown, a lever 102 is pivotally attached to arm 52 at point 104 and has a first end contacting a stationary point 106. A second end includes a pawl 110 extending therefrom which pawl is biased against the ratchet wheel 112. A spring 116 biases the lever 102 in a clockwise direction and a stop 118 will serve to limit the extent of the clockwise movement.

In operation, as the tip 60 moves away from drum 10, the first end bears against 106 rotating arm 102 counter clockwise and driving pawl against ratchet wheel 112 to rotate the inter connected tip 60. This presents a new portion of edge 62 into operative contact with surface 20. Other means may be used to perform the same function. Also, the cleaning means (80 in FIG. 1) may be integrated into this rotating structure.

Referring to FIG. 1, a spring means 92 may be provided to bias the tip 60 into contact with the surface 20 thereby leaving the cam 90 to work against the spring bias when moving tip 60 out of engagement with surface 20.

In practice it has been found advantageous to position the stripping means 50 such that the pivot point 58 lies in a plane 99 generally tangent to the surface 20 at the point 65.

The material used for the tip 60 may be of any suitable type such as for example, hardened metal or long wearing plastics. For example, the disc may be hardened steel having a coating of silver, or other plated material in the area of contact. The coated material can be of a softer or harder material from that of the disc according to which is found most advantageous for given conditions of working and for given surface material.

From the foregoing it will be appreciated that the invention provides an efficient and reliable stripping means that overcomes the limitations of the prior art. It will also be understood that various modifications may be made to the specific details referred to herein without departing from the scope of the invention as defined in the appended claims.

What is claimed is:

1. Apparatus for stripping sheet material from the photoreceptor of an electrostatographic copying machine following electrostatic transfer contact of said sheet material with said machine photoreceptor, comprising, in combination:

a support arm, rotatable tip means and means attaching said tip means to said support arm adjacent one end of said support arm for contact with said photoreceptor, said tip means photoreceptor contact comprising an edge of a generally circular configuration.

2. The apparatus according to claim 1, wherein said tip means comprises a circular disc said attaching means connecting said disc for axial rotation to said support arm one end.

3. The apparatus according to claim 2, wherein said disc has generally parallel first and second circular sides, said first side having a greater diameter than said second side, said attaching means connecting said disc so that said disc second side is closest to said photoreceptor, said edge being defined by the circumferences of said first and second sides.

4. The apparatus according to claim 3, wherein said photoreceptor comprises a cylinder, said edge contacting the cylindrical surface of said photoreceptor at a point whereby the portion of said edge nearest the circumference of said first side is spaced from said photoreceptor surface.

5. The apparatus according to claim 3, wherein said photoreceptor comprises a cylinder, said edge having a frusto-conical shape defined by the circumferences of the first and second sides, said edge being in point contact with the cylindrical surface of said photoreceptor.

6. The apparatus according to any of claim 5, wherein said circumference of said first side of said disc is spaced substantially 0.0005 inches from said photoreceptor cylindrical surface.

7. The apparatus according to claim 3, wherein said photoreceptor comprises a cylinder, said edge having a concave cross-sectional configuration generally conforming to the cylindrical surface of said photoreceptor.

8. The apparatus according to claim 1, wherein said photoreceptor comprises a cylinder, said tip means laying in a plane substantially parallel to the axis of said cylinder.

9. The apparatus according to claim 1, wherein said tip means is attached to said support arm by said supporting means so that contact of said tip means with said photoreceptor causes said tip means to rotate on movement of said photoreceptor.

10. The apparatus according to claim 1, wherein said photoreceptor comprises a cylinder, said tip means being attached to said support arm by said supporting means with said tip means in a plane at an angle to the axis of said cylinder.

11. The apparatus according to claim 1, wherein said tip means edge is coated with silver.

12. The apparatus according to claim 1 wherein said support arm includes a cleaning means for cleaning said rotatable tip means at a point remote from contact of said tip means with said photoreceptor.

13. The apparatus according to claim 1, including control means connected to said support arm to move said rotatable tip means into and out of contact with said photoreceptor said control means including means to rotate said tip means during movement thereof.

14. The apparatus according to claim 1 wherein said support arm is pivotally mounted at a point remote from said tip means, and resilient means to bias said tip means into contact with said photoreceptor.

15. The apparatus according to claim 13 wherein said control means moves said tip means into and out of contact with said photoreceptor in timed relationship with said sheet material whereby said tip means is brought into contact with said photoreceptor on arrival of said sheet material.

16. The apparatus according to claim 1, wherein said photoreceptor comprises a cylinder, said support arm being pivotally mounted at a point remote from said tip means, said support arm mounting point lying in a plane tangent to said cylinder.

17. The apparatus according to claim 3, wherein said disc second side is convex.

18. The apparatus according to claim 1, including control means for moving said tip means into and out of contact with said photoreceptor, said control means having drive means for rotating said tip means to present fresh tip means edge.

* * * * *